US005230447A

United States Patent [19]

Kirk

[11] Patent Number: 5,230,447

[45] Date of Patent: Jul. 27, 1993

[54] SELF-CLOSING PUSH-PULL BOTTLE TOP

[76] Inventor: Norbert Kirk, 1458 Belle Plaine, Chicago, Ill. 60613

[21] Appl. No.: 704,364

[22] Filed: May 23, 1991

[51] Int. Cl.[5] ..... B67D 9/00

[52] U.S. Cl. ..... 222/505; 222/514; 222/518; 222/524

[58] Field of Search ..... 222/513, 514, 518, 522, 222/523, 524, 525, 507, 505, 509, 537, 496; 220/253; 215/219

[56] References Cited

U.S. PATENT DOCUMENTS

| | | | |
|---|---|---|---|
| 1,472,695 | 10/1923 | Stapley | 222/514 |
| 2,112,125 | 3/1938 | von Bültzingslöwen | 222/522 |
| 2,130,861 | 9/1938 | Sebell | 222/514 |
| 2,147,289 | 2/1939 | Furedy | 222/514 |
| 2,183,456 | 12/1939 | Kelner | 222/513 |
| 2,547,744 | 4/1951 | Burger | 222/514 |
| 2,596,592 | 5/1952 | Parker | 222/514 |
| 2,695,737 | 11/1954 | Schlicksupp | 222/513 |
| 2,889,088 | 6/1959 | Gardner | 222/523 |
| 2,974,835 | 3/1961 | Herbrick | 222/507 |
| 3,095,128 | 6/1963 | Wonso | 222/514 |
| 3,252,634 | 5/1966 | Scholle | 222/514 |
| 3,297,206 | 1/1967 | Scholle | 222/514 |
| 3,343,719 | 9/1967 | Kastamo et al. | 222/514 |
| 3,885,712 | 5/1975 | Libit | 222/525 |
| 4,008,834 | 2/1977 | Towns | 222/513 |
| 4,516,702 | 5/1985 | Schmidt | 222/514 |

FOREIGN PATENT DOCUMENTS

| | | | |
|---|---|---|---|
| 104692 | 12/1937 | Australia | 222/522 |
| 825740 | 8/1937 | France | 222/496 |
| 724798 | 2/1953 | United Kingdom | 222/496 |

*Primary Examiner*—Andres Kashnikow
*Assistant Examiner*—A. Pomrening
*Attorney, Agent, or Firm*—McAndrews, Held & Malloy, Ltd.

[57] ABSTRACT

A self-closing push-pull top for a bottle includes a threaded collar adapted to engage a threaded bottle neck. A hollow stem extends from the threaded collar and engages a cylindrical guide aperture of a cap. The cap is slidable along the hollow stem about the guide aperture to a first position in which the hollow stem and the cap are positioned with respect to one another to prevent fluid flow from the bottle. The cap is further slidable along the hollow stem about the guide aperture to a second position in which the hollow stem and the cap are positioned to allow fluid flow therethrough. A biasing member is provided for biasing the cap in the first position. Since the cap is biased in this first position, it normally remains closed. Upon application of working pressure, the biasing member deforms to allow the cap to slide to the second position in which fluid may be dispensed from the bottle. Once the working pressure is removed, the biasing member urges the cap back to the first position thereby closing the top to prevent further fluid flow from the bottle.

13 Claims, 5 Drawing Sheets

FIG. 1
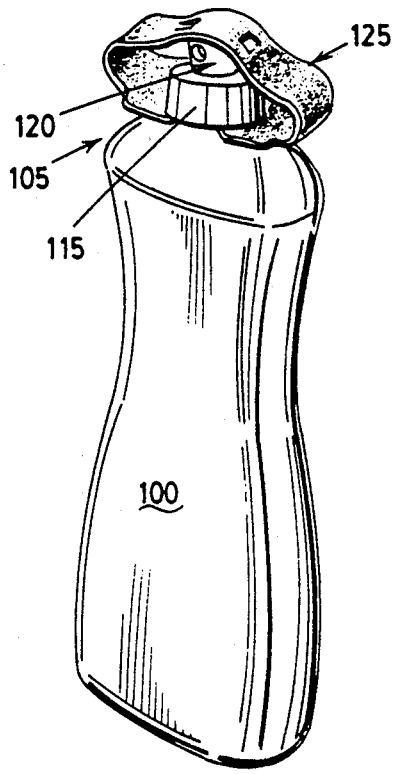
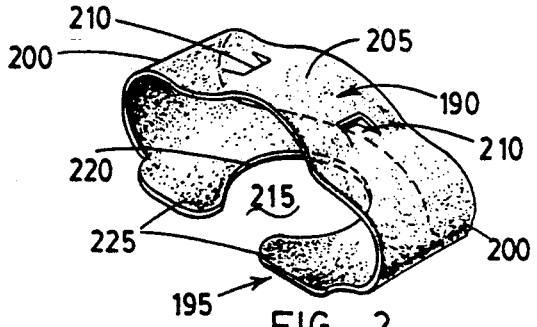
FIG. 2
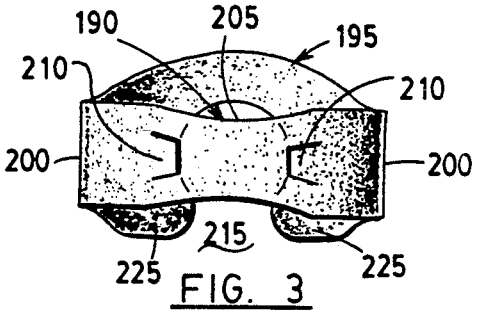
FIG. 3
FIG. 4
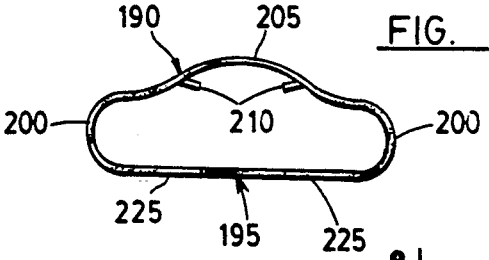
FIG. 5
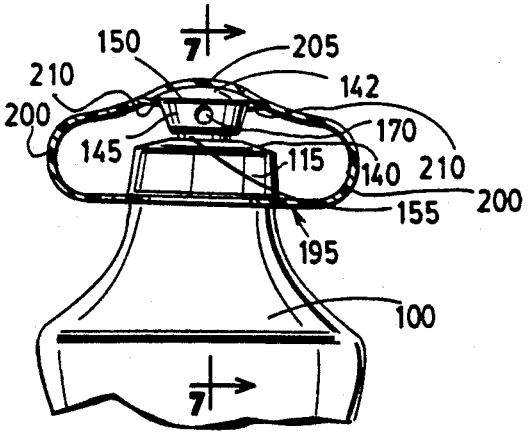
FIG. 6
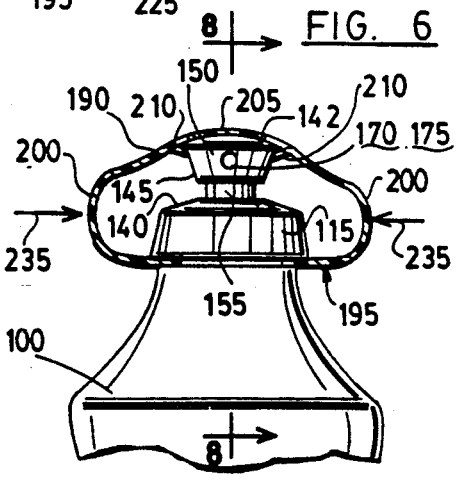

FIG. 10
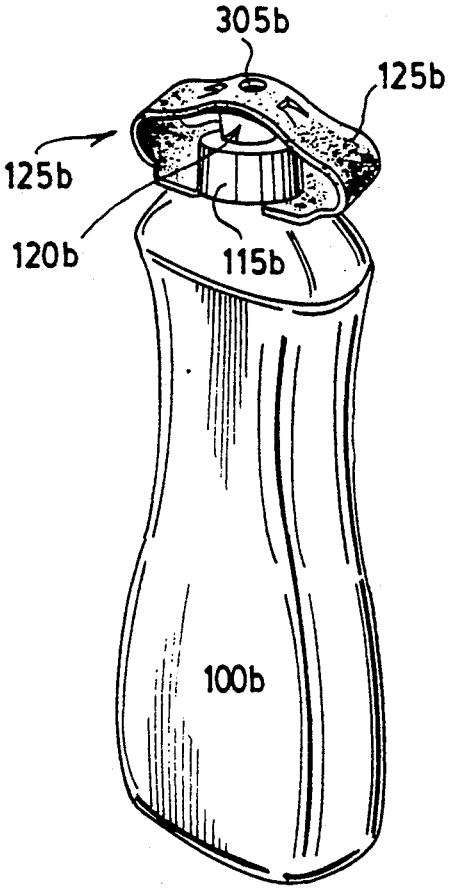
FIG. 11
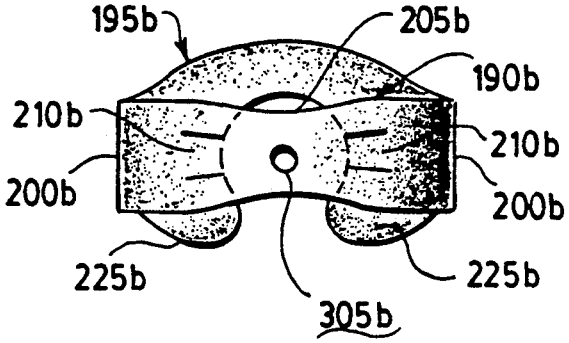
FIG. 26
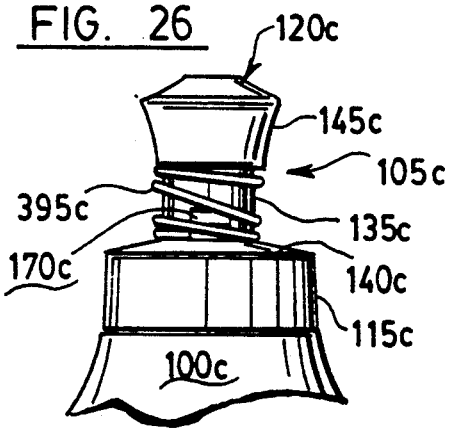
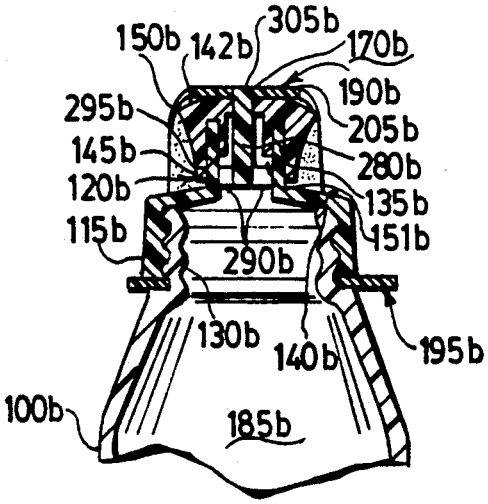
FIG. 12
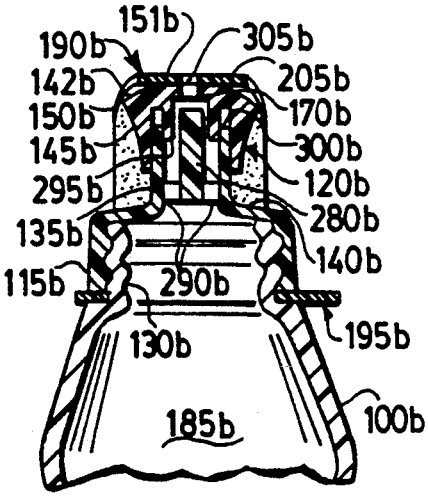
FIG. 13

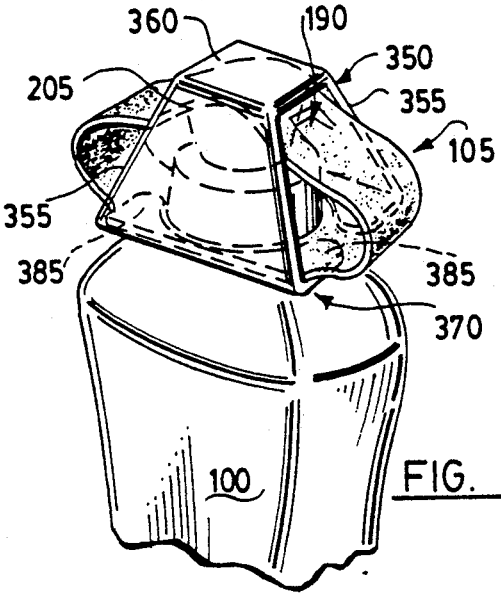
FIG. 16
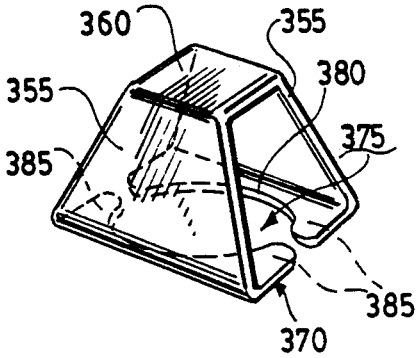
FIG 17
FIG. 18
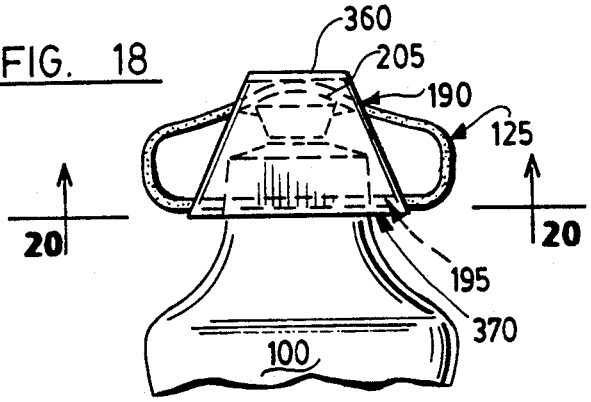
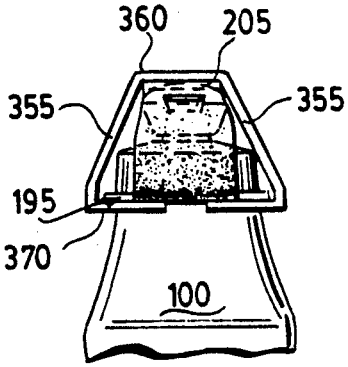
FIG. 19
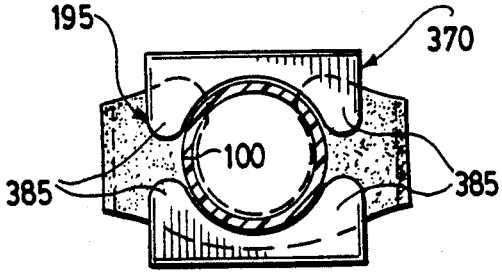
FIG. 20

FIG. 21
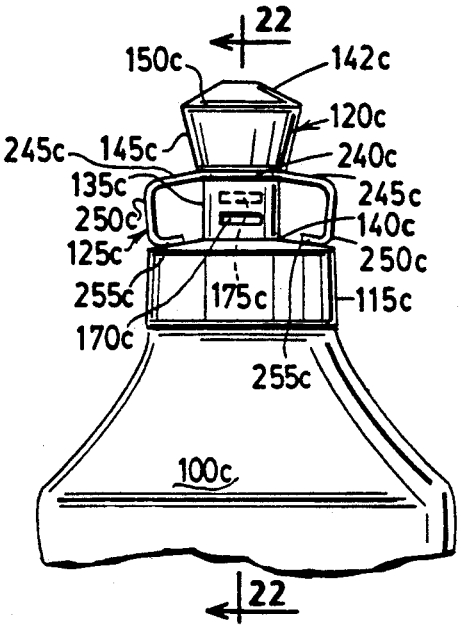
FIG. 22
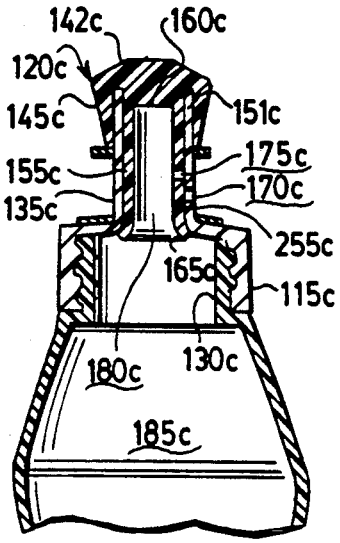
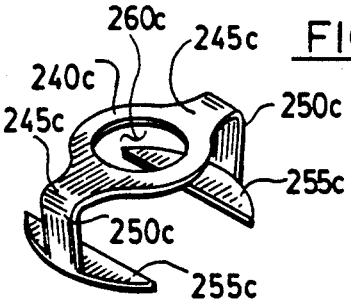
FIG. 25
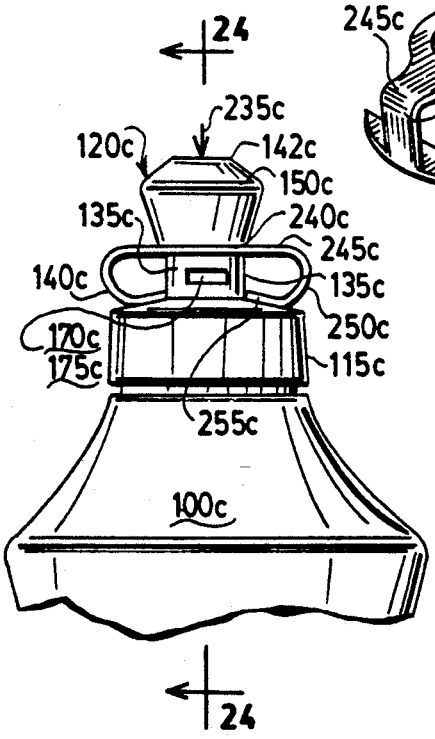
FIG. 23
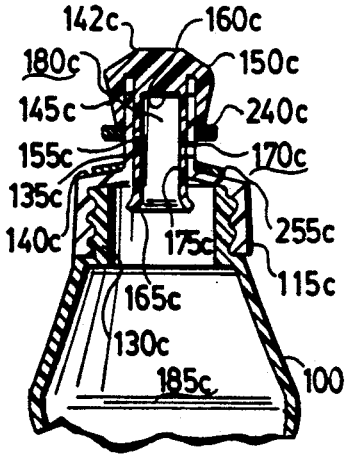
FIG. 24

SELF-CLOSING PUSH-PULL BOTTLE TOP

BACKGROUND OF THE INVENTION

The present invention is directed to a self-closing bottle top and, more particularly, to a self-closing push-pull bottle top adapted for use with conventional-type bottles that are used to dispense common household fluids, i.e., dishwashing detergent, pancake syrup, etc.

Conventional-type bottles containing common household fluids such as dishwashing liquid are frequently provided with a top-pouring push-pull top. The push-pull top includes a threaded collar which engages the threaded neck of the bottle. A hollow stem extends outward from a surface of the threaded collar. A plug member extends through a central portion of the hollow stem. A cap is provided with a centrally disposed guide aperture which accepts the hollow stem therein. The cap is further provided with an outlet aperture which is disposed through a domed portion of the cap.

The cap is capable of sliding along a length of the hollow stem. When pushed toward the threaded collar, the plug within the hollow stem engages the outlet aperture in the domed portion of the cap thereby preventing a flow of fluid through the outlet aperture. When pulled in a direction away from the threaded collar, the plug disengages from the outlet aperture thereby allowing the fluid within the bottle to flow through the outlet aperture.

After dispensing fluid from the bottle, an amount of residual fluid typically remains on the cap in the region of the outlet aperture. In order to close the push-pull top, an individual must place his/her finger over the aperture and depress the cap so that the plug engages the outlet aperture. Consequently, the individual's finger must contact the residual fluid. Closing the top thus becomes a rather messy process, particularly where the fluid is, for example, dishwashing detergent or syrup.

It is therefore an object of the present invention to provide a self-closing push-pull bottle top for conventional-type bottles which allows the individual user to close the cap without contacting any residual fluid located near the outlet aperture.

It is a further object of the present invention to provide a self-closing push-pull bottle top for conventional-type bottles which allows the bottle to be invertibly suspended on a mounting bracket in a ready-to-use manner.

It is a still further object of the present invention to provide a biasing member which can be fitted to known push-pull caps to convert such caps to self-closing bottle caps.

It is a still further object of the invention to provide a side-pouring self-closing bottle top.

SUMMARY OF THE INVENTION

The present invention is directed to a self-closing push-pull bottle top. The bottle top includes a threaded collar adapted to engage a threaded bottle neck. A hollow stem extends from the threaded collar and engages a central guide aperture of a cap. The cap is slidable along the hollow stem to a first position in which the hollow stem and the cap are positioned with respect to one another to prevent fluid flow from the bottle. The cap is further slidable along the hollow stem to a second position in which the hollow stem and the cap are positioned to allow fluid flow from the bottle.

To facilitate self-closing, a biasing member is provided for biasing the cap in the first position. Since the cap is biased in the first position, it normally remains closed. Upon application of working pressure, the biasing member elastically deforms to allow the cap to slide along the hollow stem to the second position thereby allowing fluid to flow from the bottle. Once the working pressure is removed, the biasing member urges the cap back to the first position thereby closing the top to prevent further fluid flow from the bottle. In a particular advantageous embodiment of the invention, the biasing member also provides means for urging the cap to the second position when working pressure is applied.

BRIEF DESCRIPTION OF THE DRAWINGS

Other objects, features and advantages of the present invention will become apparent upon review of the description of the preferred embodiments taken in conjunction with the following drawings, on which:

FIG. 1 is a perspective view of a bottle employing one embodiment of the present invention.

FIG. 2 is a perspective view of the biasing member utilized in the embodiment of the invention shown in FIG. 1.

FIG. 3 is a top plan view of the biasing member shown in FIG. 2.

FIG. 4 is a side plan view of the biasing member shown in FIG. 2.

FIG. 5 is a side plan view of the embodiment of the invention shown in FIG. wherein the self-closing bottle top is shown biased to its normally closed position.

FIG. 6 is a side plan view of the embodiment of the invention shown in FIG. 1 wherein working pressure has been applied to urge the cap along the hollow stem to place the top in its open position.

FIG. 10 is a perspective view of a bottle employing a second embodiment of the present invention.

FIG. 11 is a top plan view of the biasing member utilized in the embodiment of the invention shown in FIG. 10.

FIG. 12 is a cross-sectional view of the embodiment of the invention shown in FIG. 10 wherein the self-closing top is shown biased to its normally closed position.

FIG. 13 is a cross-sectional view of the embodiment of the invention shown in FIG. 10 wherein the self-closing top is shown as having working pressure applied to urge the cap along the hollow stem to place the top in its open position.

FIG. 16 is a perspective view of an embodiment of the invention having a shipping cap attached.

FIG. 17 is a perspective view of the shipping cap employed in FIG. 16.

FIG. 18 is a front view of the embodiment of the invention shown in FIG. 16.

FIG. 19 is a side view of the embodiment of the invention shown in FIG. 16.

FIG. 20 is a cross-sectional view of the embodiment of the invention shown in FIG. 18 taken along line 20—20.

FIG. 21 is a plan view of a third embodiment of the invention wherein the self-closing top is shown biased to its normally closed position.

FIG. 22 is a cross-sectional view of the embodiment of the invention shown in FIG. 21 taken along line 22—22.

FIG. 23 is a plan view of the embodiment of the invention shown in FIG. 21 wherein working pressure has been applied to urge the cap along the hollow stem to place the top in its open position.

FIG. 24 is a cross-sectional view of the embodiment of the invention shown in FIG. 23 taken along line 24—24.

FIG. 25 is a perspective view of the biasing member used in the embodiment of the invention shown in FIG. 21.

FIG. 26 is a plan view of the embodiment of the invention shown in FIG. 16 employing a spring to bias the top in its normally closed position.

DESCRIPTION OF THE PREFERRED EMBODIMENTS

Figure 7:
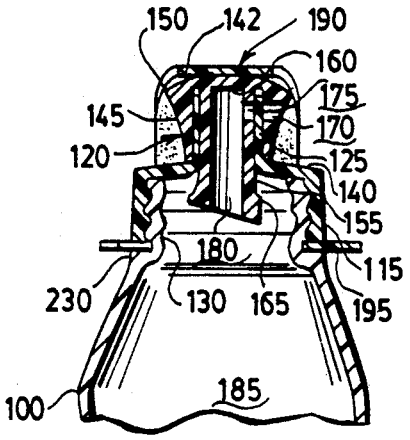
FIG. 7 is a cross-sectional view of the self-closing bottle top shown in FIG. 5 taken along line 7—7.

Referring to FIG. 1, there is shown a bottle 100 capable of holding, for example, pancake syrup or dishwashing liquid. Bottle 100 is shown with one embodiment of a self-closing push-pull bottle top assembly 105. Generally stated, self-closing bottle top assembly 105 includes threaded collar 115, cap 120 and biasing member 125.

With reference to FIGS. 5–8, threaded collar 115 engages the threaded neck 130 of bottle 100. Hollow stem 135 extends outward from a central region of surface 140 of threaded collar 115.

Cap 120 includes a domed surface 142 and flared sidewall 145. Domed surface 142 and flared sidewall 145 join to form lip 150. The inner surface of flared sidewall 145 defines a cylindrical guide aperture 151. Tube 155 extends from a central interior portion of cap 120 and is substantially concentric with cylindrical guide aperture 151. As shown, tube 155 is integral with cap 120 and terminates in end wall 160 at the end of tube 155 joined to cap 120. At the other end of tube 155, opposite cap 120, tube 155 terminates with an open end having a flange 165.

Outlet aperture 170 is disposed through flared sidewall 145 of cap 120. A corresponding opening 175 is disposed through the sidewall of tube 155. Outlet aperture 170 and opening 175 are in substantial alignment with one another. Channel 180 extends from the open end of tube 155 to opening 175.

Figure 8:
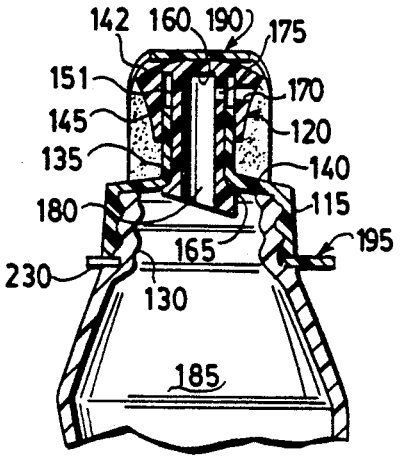
FIG. 8 is a cross-sectional view of the self-closing top shown in FIG. 6 taken along line 8—8.

As shown in FIGS. 7 and 8, tube 155 extends into hollow stem 135. Hollow stem 135 is thus disposed in guide aperture 151 in the interstitial region between tube 155 and flared sidewall 145 of cap 120. The outer surfaces of the sidewall of tube 155 and sidewall of guide aperture 151 form guide surfaces on which cap 120 may slide with respect to hollow stem 135.

FIG. 7 shows cap 120 in a first position with respect to hollow stem 135. In this position, hollow stem 135 is interposed between opening 175 of tube 155 and outlet aperture 170 thus blocking any fluid which might otherwise flow therebetween.

FIG. 8 shows cap 120 after sliding to a second position with respect to hollow stem 135. In this position, hollow stem 135 is no longer interposed between opening 175 of tube 155 and outlet aperture 170. Consequently, fluid may flow from the interior 185 of bottle 100, through channel 180 to opening 175, and therefrom through outlet aperture 170. Flange 165 prevents cap 120 from being pulled out of hollow stem 135 when cap 120 is in this second position.

Biasing member 125 is shown in detail in FIGS. 2–4 where it is shown separate from other portions of the bottle top assembly 110. As shown in FIGS. 2 and 4, biasing member 125 is in the shape of a "Dutch Hat" and includes first section 190, second section 195, and a pair of opposed curved sections 200, 200.

Figure 9:
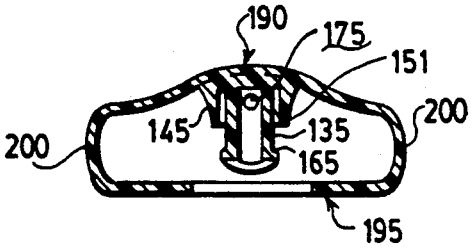
FIG. 9 is a cross-sectional view of the cap and biasing member of the embodiment of FIG. 1 constructed as a single integrated structure.

First section 190 has a contoured portion 205 and a pair of fingers 210, 210 which extend toward one another. As illustrated in FIGS. 5 and 6, contoured portion 205 and fingers 210, 210 are spaced apart from one another so as to grip domed surface 142 and lip 150 of cap 120. When engaged in this fashion, cap 120 is in substantially fixed alignment with respect to first section 190 of biasing member 125. Alternatively, first section 190 of biasing member 125 can be constructed to be integral with cap 120. (FIG. 9). Lexan TM, Hyzod TM or another similar flexible and durable polycarbonate material may be used to make biasing member 125.

Second section 195 includes a slotted aperture 215 which is defined by rim 220. Arms 225, 225 define the slotted portion of slotted aperture 215 and are spaced apart from one another at a distance slightly less than the outer diameter of the base of threaded neck 130 of bottle 100. The substantially circular portion of slotted aperture 215 is slightly greater in diameter than the outer diameter of threaded neck 130 but less than the outer diameter of the threads on neck 130.

FIGS. 5–8 show biasing member 125 as applied to bottle 100 with the other members of the bottle top assembly 105. The base of threaded neck 130 terminates in flange 230. Rim 220 of slotted aperture 215 is gripped between the bottom portion of threaded collar 130 and flange 230. This configuration places second section 195 in substantially fixed alignment with respect to threaded collar 115.

Application of biasing member 125 to the other parts of the assembly is relatively simple since biasing member 125 is made from a flexible material (i.e. Lexan TM), arms 225, 225 may be spread apart so that biasing member 125 may be laterally urged against threaded neck 130 until the neck is disposed within the substantially circular section of slotted aperture 215. At the same time, contoured portion 205 and fingers 210, 210 are urged against cap 120 to grip lip 150 and domed surface 142.

As will suggest itself, the aperture in second section 195 need not necessarily be slotted. Rather, a non-slotted aperture could be used provided it is of a sufficient diameter to fit over the threads of threaded neck 130.

FIGS. 5 and 7 show bottle top assembly 105 in its closed state. In the absence of an external working pressure, biasing member 125 provides a compressive force which urges first and second sections 190, 195 toward one another. Since cap 120 is in substantially fixed alignment with first section 190 and threaded collar 115 is in substantially fixed alignment with second section 195, cap 120 is forced along hollow stem 135 toward threaded collar 115. In this first position, hollow stem 135 is interposed between opening 175 of tube 155 and outlet aperture 170 thus blocking any fluid which might otherwise flow out of the bottle.

FIGS. 6 and 8 show the bottle top assembly 105 under the influence of working pressure. Working pressure is applied in the direction of arrows 235, 235 to compress the opposed curved sections 200, 200 of biasing member 125. The application of pressure causes opposed curved portions 200, 200 to elastically deform thereby urging first and second sections 190, 195 of biasing member 125 away from one another. Since cap 120 is in substantially fixed alignment with first section 190 and threaded collar 115 is in substantially fixed alignment with second section 195, cap 120 slides along hollow stem 135 away from threaded collar 115. In this position, hollow stem 135 is no longer interposed between opening 175 of tube 155 and outlet aperture 170. Consequently, fluid may flow from the interior 185 of bottle 100, through channel 180 to opening 175 and therefrom through outlet aperture 170. Once the working pressure 235, 235 is released, the opposed curved portions 200, 200 elastically return to their original shape thereby urging ca 120 along hollow stem 135 back to the closed position shown in FIGS. 5 and 7.

A second embodiment of the present invention is shown with reference to FIGS. 10-15. Bottle 100*b* is shown with a top-pouring push-pull bottle top assembly 105*b*. Generally stated, assembly 105*b* includes threaded collar 115*b*, cap 120*b* and biasing member 125*b*.

With reference to FIGS. 12 and 13, threaded collar 115*b* engages threaded neck 130*b* of the bottle 100*b*. Hollow stem 135*b* extends outward from a central region of surface 140*b* of threaded collar 115*b*. Plug member 280*b* is coaxially disposed within the hollow central interior portion of hollow stem 135*b* and extends beyond the upper rim 300*b*. Webbing 290*b* attaches plug member 280*b* to hollow stem 135*b*.

Cap 120*b* includes a domed surface 142*b* and flared sidewall 145*b*. Outlet aperture 170*b* is disposed through domed surface 142*b*. Domed surface 142*b* and flared sidewall 145*b* join to form lip 150*b*. Short cylinder 295*b* extends from a central interior portion of cap 120*b*. Cylinder 295*b* is substantially concentric with cylindrical guide aperture 151*b*. The sidewall of guide aperture 151*b* and outer surface of cylinder 295*b* constitute guide surfaces upon which cap 120*b* slides with respect to hollow stem 135*b*.

FIG. 12 shows cap 120*b* in a first position with respect to hollow stem 135*b*. In this position, plug member 280*b* engages outlet aperture 170*b* thus blocking any fluid which might otherwise flow therebetween.

FIG. 13 shows cap 120*b* after sliding to a second position with respect to hollow stem 135*b*. In this position, plug member 280*b* is disengaged from outlet aperture 170*b*. Consequently, fluid may flow from the interior 185*b* of bottle 100*b*, past webbing 290*b* and plug member 280*b*, and through outlet aperture 170*b*. Cylinder 295*b* and upper rim 300*b* (FIG. 13) of hollow stem 135*b* may be provided with mating flanges (not shown) to prevent 120*b* from disengaging from the hollow stem 135*b*.

FIG. 11 shows biasing member 125*b* detached from other portions of the bottle top assembly 105*b*. As shown, biasing member 125*b* is similar in all respects to the biasing member 125 shown in FIGS. 2-4, except that biasing member 125*b* has aperture 305*b* disposed through contoured portion 205*b* of first section 190*b*. By placing aperture 305*b* in the position shown, biasing member 125*b* may be fitted on the top-pouring push-pull tops used on conventional bottles containing common household fluids, such as those containing dishwashing liquid. Biasing member 125*b* thus constitutes a single integrated structure which can be used with the push-pull tops of conventional bottles to convert such bottle tops into self-closing bottle tops. Lexan TM, Hyzod TM or another similar flexible and durable polycarbonate material may be used to make biasing member 125*b*.

Biasing member 125*b* engages threaded neck 130*b* and cap 120*b* in the same manner as biasing member 125 engages threaded neck 130 and cap 120 in FIGS. 5-8 of the first embodiment described above. First section 190*b* is thus in substantially fixed positional alignment with cap 120*b* and second section 195*b* is thus in substantially fixed positional alignment with threaded collar 115*b*. Aperture 305*b* in first section 190*b* is in substantial alignment with outlet aperture 170*b* in domed surface 142*b* of cap 120*b*.

As will suggest itself, the specific construction of biasing member 125*b* can vary in the same manner as noted above with respect to biasing member 125 of the first embodiment.

FIG. 12 shows bottle top assembly 105*b* in its closed state. In the absence of an external working pressure, biasing member 125*b* provides a compressive force which urges first and second sections 190*b*, 195*b* toward one another. Since cap 120*b* is in substantially fixed positional alignment with first section 190*b* and threaded collar 115*b* is in substantially fixed positional alignment with second section 195*b*, cap 120*b* slides along hollow stem 135*b* toward threaded collar 115*b*. In this first position, plug member 280*b* engages outlet aperture 170*b* thus blocking any fluid which might otherwise flow therethrough.

FIG. 13 shows bottle top assembly 105*b* under the influence of working pressure. Working pressure is applied in the same manner shown in FIG. 6 of the first embodiment to compress the opposed curved sections 200*b*, 200*b* of biasing member 125*b*. The application of pressure causes opposed curved portions 200*b*, 200*b* to elastically deform thereby urging first and second sections 190*b*, 195*b* of biasing member 125*b* away from one another. Since cap 120*b* is in substantially fixed positional alignment with first section 190*b* and threaded collar 115*b* is in substantially fixed positional alignment with second section 195*b*, cap 120*b* slides along hollow stem 135*b* away from threaded collar 115. In this position, plug member 280*b* is disengaged from outlet aperture 170*b*. Consequently, fluid may flow from the interior 185*b* of bottle 100*b*, past webbing 290*b* and plug member 280*b*, and through outlet aperture 170*b*. Once the working pressure is released, the opposed curved portions 200*b*, 200*b* elastically return to their original shape thereby sliding cap 120*b* along hollow stem 135*b* back to the closed position shown in FIG. 12.

Figure 14:
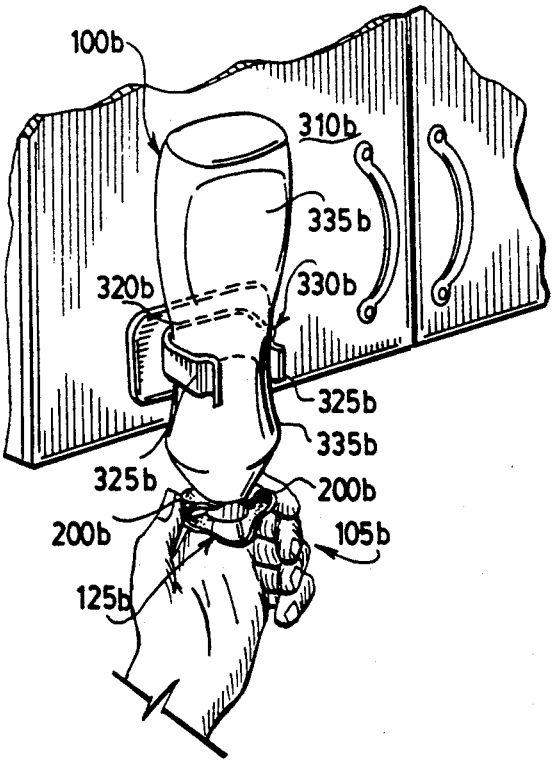
FIG. 14 is a perspective view of a bottle employing the embodiment of the invention shown in FIG. 10 wherein the bottle including the self-closing top is invertibly attached to a cabinet door in a ready-to-use position.

FIG. 14 shows bottle 100*b* and bottle top assembly 105*b* invertibly mounted to cabinet 310*b* in a ready-to-use manner. Bottle 100*b* includes a necked portion 320*b* which engages opposed arms 325*b*, 325*b* of mounting bracket 330*b*. Flared portions 335*b*, 335*b* are disposed on each side of necked portion 320*b*. Arms 325*b*, 325*b* are elastically deformable to grip necked portion 320*b* of bottle 100*b* thereby securing bottle 100*b* to mounting bracket 330*b*.

Figure 15:
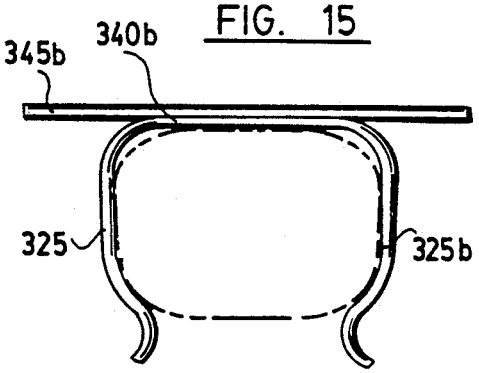
FIG. 15 is a top plan view of the mounting bracket employed in FIG. 14.

As shown in FIGS. 14 and 15, arms 325*b*, 325*b* are constructed as an integrated structure and are connected by connecting section 340b. Connecting section 340b is secured to plate 345b by, for example, glue, screws, etc. Back wall 350b of plate 345b may be provided with a sticky backing (not shown) to secure mounting bracket 330b to cabinet 310b. Alternatively, plate 345b may be fastened to cabinet 310b by screws (not shown).

In the inverted position of FIG. 14, working pressure may be applied to biasing member 125b by gripping opposed curved sections 200b, 200b between, for example, the user's thumb and forefinger. This will urge bottle top assembly 105b to its open position and allow, for example, dishwashing fluid to be dispensed from bottle 100b into, for example, a sink located below bottle 100b or into a cup or other receptacle. After the user releases the working pressure, bottle top assembly 105b will return to its closed position.

FIGS. 16–20, show a shipping cap 350 which may be used to maintain bottle top assemblies 105, 105b of the first and second embodiments described above in their closed state during shipment. Shipping cap 350 includes slanted sections 355, 355. Each slanted section 355, 355 is in the form of a parallelogram. Slanted sections 355, 355 are connected by top section 360. Bottom section 370 includes a double slotted aperture 375 defined by rim 380 in the circular portion thereof and arms 385, 385, 385, 385 in the slotted portions thereof. Shipping cap 350 may be constructed from a flexible polycarbonate material such as Lexan TM or Hyzod TM.

FIGS. 16 and 18–20, show shipping cap 350 applied to bottle top assembly 105. Shipping cap 350 may be applied to the bottle top assembly by spreading arms 385, 385, 385, 385 apart until the bottle 100 is fitted within the circular portion of double slotted aperture 375.

Once shipping cap 350 is applied, top section 360 of shipping cap 350 contacts contoured portion 205 of first section 190 of biasing member 125. Bottom section 370 of shipping cap 350 contacts second section 195 of biasing member 125. This prevents first section 190 from moving away from second section 195 in the event that working pressure is accidentally applied during shipment. Bottle top assembly 105 is thereby maintained in its closed state.

A third embodiment of a self-closing push-pull bottle top is shown in FIGS. 21–25. Threaded collar 115c engages the threaded neck 130c of the bottle 100c. Hollow stem 135c extends outward from a central region of surface 140c of threaded collar 115c.

Cap 120c includes a domed surface 142c and flared sidewall 145c. Domed surface 142c and flared sidewall 145c join to form lip 150c. The inner surface of flared sidewall 145c defines a cylindrical guide aperture 151c. Tube 155c extends from a central interior portion of cap 120c and is substantially concentric with cylindrical guide aperture 151c. As shown, tube 155c is integral with cap 120c and terminates in end wall 160c at the end of tube 155c joined to cap 120c. At the other end of tube 155c, opposite cap 120c, tube 155c terminates with an open end having a flange 165c. As shown in FIGS. 22 and 24, tube 155c extends into hollow stem 135c. The outer surface of the sidewall of tube 155c and sidewall of guide aperture 151c thus form guide surfaces on which cap 120c may slide with respect to hollow stem 135c.

Outlet aperture 170c is disposed through a sidewall of hollow stem 135c. A corresponding opening 175c is disposed through the sidewall of tube 155c. Channel 180c extends from the open end of tube 155c to opening 175c and serves to guide fluid in the interior 185c of bottle 100c to opening 175c.

FIGS. 21 and 22 show cap 120c in a first position with respect to hollow stem 135c. In this position, opening 175c and outlet aperture 170c are misaligned. The inner sidewall of hollow stem 135c blocks any fluid which might otherwise flow therebetween.

FIGS. 23 and 24 show cap 120c after sliding to a second position with respect to hollow stem 135c. In this position, outlet aperture 170c is substantially aligned with opening 175c of tube 155c. Consequently, fluid may flow from the interior 185c of bottle 100c, through channel 180c to opening 175c, and therefrom through outlet aperture 170c. Flange 165c prevents cap 120c from being pulled out of hollow stem 135c when cap 120c is urged into this second position.

Biasing member 125c includes ring 240c, webbing 245c, 245c, opposed legs 250c, 250c and feet 255c, 255c. Aperture 260c is centrally disposed through ring 240c and has a diameter somewhat larger than the outer diameter of hollow stem 135c yet small enough to allow ring 240c to engage the lower edge of flared sidewall 145c of cap 120c. Webbing 245c, 245c connects ring 240c to opposed legs 250c, 250c. Opposed legs 250c, 250c curve gradually away from webbing 245c, 245c until they are substantially perpendicular to the plane containing ring 240c and webbing 245c, 245c. Feet 255c, 255c are disposed at the end of opposed legs 250c, 250c opposite webbing 245c, 245c and extended toward one another. Biasing member 125c may be made from Lexan TM, Hyzod TM or other similar flexible and durable polycarbonate material.

Ring 240c of biasing member 125c is disposed over hollow stem 135c and engages the portion of flared sidewall 145c that is opposite lip 150c. Feet 255c, 255c engage surface 140c of threaded collar 115c.

Opposed legs 250c, 250c are of sufficient length to place them under a certain degree of compressive stress when bottle top assembly 105c is in the closed state shown in FIGS. 16 and 17. In the absence of an external working pressure, the tension produced by biasing member 125c urges feet 255c, 255c and ring 240c away from one another. Flange 165c prevents cap 120c from moving further away from threaded collar 115c beyond this position. In this first position, opening 175c and outlet aperture 170c are misaligned thereby preventing a flow of fluid therethrough.

FIGS. 23 and 24 show bottle top assembly 105c under the influence of working pressure. Working pressure is applied in the direction of arrow 235c to domed surface 142c of cap 120c. This pressure urges cap 120c toward threaded collar 115c and compresses opposed legs 250c, 250c of biasing member 125c. Opposed legs 250c, 250c elastically deform under the influence of this pressure thereby allowing cap 120c to slide along hollow stem 135c toward threaded collar 115c until opening 175c of tube 155c and outlet aperture 170c are in substantial alignment. At this point, fluid may flow from the interior 185c of bottle 100c, through channel 180c to opening 175c and therefrom through outlet aperture 170c. Once the working pressure 235c is released, the opposed legs 250c, 250c elastically return to their original shape thereby urging cap 120c along hollow shaft 135c back to the closed position shown in FIGS. 16 and 17.

FIG. 26 shows a further configuration for biasing bottle top assembly 105c in its closed position. Spring 395c is disposed about the exterior of hollow stem 135c and engages the lower edge of flared sidewall 145c of cap 120c at one end and surface 140c of threaded collar 115c at the other end. In the absence of working pressure, spring 395c provides the necessary force to urge cap 120c away from threaded collar 115c to maintain bottle top assembly 105c in its closed position. When working pressure is applied, spring 395c compresses and deforms thereby allowing cap 120c to move along hollow stem 135c to its second position in which fluid may flow from bottle 100c.

The coils of spring 395c are spaced apart so as to avoid impeding the flow of fluid from outlet aperture 170c when cap 120c is in the second position. For example, spring 395c of FIG. 26 is constructed having a single coil disposed proximate the lower edge of flared sidewall 145c and another single coil proximate surface 140c of threaded collar 115c. The coils respectively located at the lower edge of flared sidewall 145c and surface 140c of threaded collar 115c are connected by a single coil turn which proceeds along the length of hollow stem 135c. This leaves outlet aperture 170c substantially free of obstructions when spring 395c is compressed.

In the side-pouring bottle tops described with respect to the first and third embodiments, it may be desirable to prevent cap 120,120c from rotating about the axis of hollow stem 135, 135c to ensure that fluid is dispensed from the desired side. Accordingly, cap 120,120c and hollow stem 135,135c may be provided with a mating rib and channel (not shown) which prevents relative rotation of cap 120,120c about hollow stem 135,135c while allowing movement of cap 120,120c along the axis of hollow stem 135,135c.

While several embodiments of the invention have been described hereinabove, those of ordinary skill in the art will recognize that the embodiments may be modified and altered without departing from the central spirit and scope of the invention. Thus, the preferred embodiments described hereinabove are to be considered in all respects as illustrative and not restrictive, the scope of the invention being indicated by the appended claims rather than by the foregoing description. Therefore, it is the intention of the inventor to embrace herein all changes which come within the meaning and range of equivalency of the claims.

I claim:

1. A self-closing push-pull tap for a bottle having a threaded collar adapted to engage a threaded bottle neck comprising:

a hollow stem extending from a surface of said threaded collar;

a cap integral with a first end of a hollow tube, said tube having a flange disposed at a second end thereof, said cap having a guide aperture accepting said hollow stem, said guide aperture being defined by a guide surface formed by a sidewall of said cap, said cap and said tube integral with said cap being slidable along said hollow stem and said guide surface to a first position in which said hollow stem and said cap are positioned such that said cap integral with said tube is in contact with a portion of said hollow stem to prevent fluid flow therethrough, said cap integral with said first end of said tube being further slidable along said hollow stem and said guide surface to a second position in which said hollow stem and said cap are positioned such that said flange abuts said surface of said threaded collar to allow fluid flow therethrough; and means for biasing said cap in said first position, said means for biasing being elastically deformable when working pressure is applied thereto allowing said cap and tube integral therewith to slide along said hollow stem and said guide aperture to said second position.

2. A self-closing push-pull tap for a bottle according to claim 1 wherein said means for biasing further provides means for urging said cap integral with said first end of said tube along said hollow stem and guide aperture to said second position.

3. A self-closing push-pull top for a bottle according to claim 1 wherein said means for biasing comprises:

a first section contacting said cap, said first section being in fixed positional alignment with said cap;

a second section contacting said threaded collar, said second section being in fixed positional alignment with said threaded collar; and a pair of opposed curved sections extending between said first and second sections, each curved section respectively curved outward from the other, application of said working pressure to said pair of opposed curved sections causing said pair of opposed curved sections to deform thereby urging said first section to move away from said second section to slide said cap into said second position.

4. A self-closing push-pull top for a bottle according to claim 3, and further comprising:

a plurality of fingers extending from said first section; and a lip disposed about said cap, said lip being gripped between said plurality of fingers and a portion of said first section.

5. A self-closing push-pull top for a bottle as recited in claim 1, and further comprising:

said tube extending from a central interior portion of said cap and through said guide aperture into said hollow stem, said tube having an opening disposed through a sidewall thereof; and said sidewall of said cap having an outlet aperture in substantial alignment with said opening of said tube, said hollow stem being interposed between said outlet aperture and said opening of said tube to prevent a flow of fluid through said outlet aperture when said cap is in said first position, movement of said cap to said second position resulting in unblocked alignment between said outlet aperture and said opening of said tube to allow a flow of fluid from said opening of said tube through said outlet aperture.

6. A self-closing push-pull top for a bottle as recited in claim 1, wherein said tube extending from a central interior portion of said cap through said guide aperture and into said hollow stem, said tube having an opening disposed through a sidewall thereof.

7. A self-closing push-pull top for a bottle according to claim 1, wherein said means for biasing is made from a flexible polycarbonate material.

8. A self-closing push-pull top for a bottle according to claim 1, and further comprising a shipping top engaging said means for biasing to prevent said means for biasing from urging said cap to said second position when working pressure is applied.

9. A self-closing push-pull top for a bottle comprising:

a threaded collar adapted to engage a threaded bottle neck;

a hollow stem extending from said threaded collar;

a cap having a guide aperture accepting said hollow stem and further having an outlet aperture disposed through a sidewall thereof, said guide aperture being defined by a guide surface formed by said sidewall;

a tube extending from a central interior portion of and integral at a first end with said cap through said guide aperture and into said hollow stem, said tube having a flange disposed at a second end thereof said tube having an opening through a sidewall thereof, said opening being in substantial alignment with said outlet aperture of said cap; and means for biasing said cap along said hollow stem in a first position in which said hollow stem is interposed between said opening in said sidewall of said tube and said outlet aperture to prevent a flow of fluid therethrough, said means for biasing further providing means for sliding said cap integral with said first end of said tube along said hollow stem and said guide surface to a second position when working pressure is applied to said means for biasing, movement of said cap to said second position resulting in unblocked alignment between said outlet aperture and said opening in said sidewall of said tube to allow a flow of fluid from said opening of said tube through said outlet aperture.

10. A self-closing push-pull top for a bottle according to claim 9, wherein said means for biasing comprises:

a first section gripping said cap;

a second section adapted to be held in fixed positional alignment with said threaded collar; and a pair of opposed curved sections extending between said first and second sections, each curved section respectively curved outward from the other, application of said working pressure to said pair of opposed curved sections causing said pair of opposed curved sections to deform thereby urging said first section to move away from said second section to slide said cap into said second position.

11. A self-closing push-pull top for a bottle according to claim 10, and further comprising:

a plurality of fingers extending from said first section; and a lip disposed about said cap, said lip being gripped between said plurality of fingers and a portion of said first section.

12. A self-closing push-pull top for a bottle according to claim 9, wherein said means for biasing is made from a flexible polycarbonate material.

13. A self-closing push-pull top for a bottle according to claim 9, and further comprising a shipping top engaging said means for biasing to prevent said means for biasing from urging said cap to said second position when working pressure is applied.

* * * * *